United States Patent [19]

Boris

[11] 4,025,046

[45] May 24, 1977

[54] LIQUID ATOMISERS

[75] Inventor: Michel Boris, Paris, France

[73] Assignee: Societe Technique de Pulverisation, Paris, France

[22] Filed: Mar. 19, 1976

[21] Appl. No.: 668,600

[30] Foreign Application Priority Data

Mar. 28, 1975 France ..... 75.10688
June 19, 1975 France ..... 75.20179

[52] U.S. Cl. ..... 239/333; 222/321; 222/385; 417/549

[51] Int. Cl.[2] ..... B05B 9/043

[58] Field of Search ..... 239/333, 331; 222/341, 222/383, 384, 385; 417/545, 547, 549

[56] References Cited

UNITED STATES PATENTS 3,414,169 12/1968 Corsette ..... 222/321
3,739,955 6/1973 Gores ..... 222/385
3,746,260 7/1973 Boris ..... 222/385 X

*Primary Examiner*—Evon C. Blunk
*Assistant Examiner*—Michael Mar
*Attorney, Agent, or Firm*—Eyre, Mann, Lucas & Just

[57] ABSTRACT

An atomizer comprises a cylinder defining a pump chamber and containing a piston. The chamber communicates with an atomizer nozzle by a valve comprising a valve member which is opened at a predetermined liquid pressure during operation of the piston to pressurize the liquid in the pump chamber. Liquid is fed into the pump chamber through a conduit which projects upwardly into the cylinder. A sleeve rigid with the valve member or the piston engages the conduit during operation of the piston to prevent communication between the conduit and the pump chamber.

12 Claims, 5 Drawing Figures

LIQUID ATOMISERS

BACKGROUND OF THE INVENTION

1. Field of the Invention.

The present invention relation relates to atomizers for perfumes or other liquids.

2. Description of the Prior Art.

There has been proposed an atomizer for perfume comprising a cylinder defining a pump chamber which is in communication with a suction tube and which receives a hollow piston. A valve member is engageable with a valve seat rigid with the piston in such a manner as to interrupt communication betweent the pump chamber and an atomising nozzle when the atomizer is in an inoperative condition.

When the piston is displaced, the pressure of liquid present within the pump chamber increases and tends to sepatate the valve member from its seat against the action of resilient bias means. When this pressure reaches a valve sufficient to overcome the resilient bias, the valve member moves away from its seat, so that the pump chamber is placed in communication with the atomising nozzle and that the liquid compressed therein escapes to the outside whilst being atomised.

In this previously proposed atomizer, a check valve is interposed between the pump cylinder and the suction tube, the check valve comprising a ball gravity-biased onto a valve seat. The check valve moves away from its seat however, when the atomizer is turned over. If this occurs during the operation of the atomizer, the atomizer is liable to malfunction and the liquid to be atomised may pass directly from the vessel containing it, to the atomising nozzle.

An object of the invention is to overcome the above disadvantages.

SUMMARY OF THE INVENTION

According to the present invention, there is provided in an atomizer, cylinder means, conduit means extending upwardly within the cylinder means to define therewith a pump chamber, said conduit means being capable of selective communication with the pump chamber, inlet means communicating with the conduit means, an atomizer nozzle, passage means providing communication between the pump chamber and the nozzle, a first piston member slidable in the cylinder to force liquid from the pump chamber to the nozzle via the passage means, valve means operative to close the passage means in an inoperative condition of the atomizer, said valve means comprising means defining a valve seat movable with the first piston member, and a valve member engageable with the seat, the pressure of the liquid in the pump chamber tending to move the valve member out of engagement with the seat whereby to open the passage, bias means biasing the valve member into engagement with the seat, and means movable during operation of the piston member to engage the conduit means and interrupt communication between the conduit means and the pump chamber, said movable means being rigid with one of said members.

BRIEF DESCRIPTION O THE DRAWINGS

Embodiments of the invention will now be described, by way of example only, with reference to the acompanying diagrammatic drawings, in which.

DESCRIPTION OF THE PREFERRED EMBODIMENTS

Figure 1:
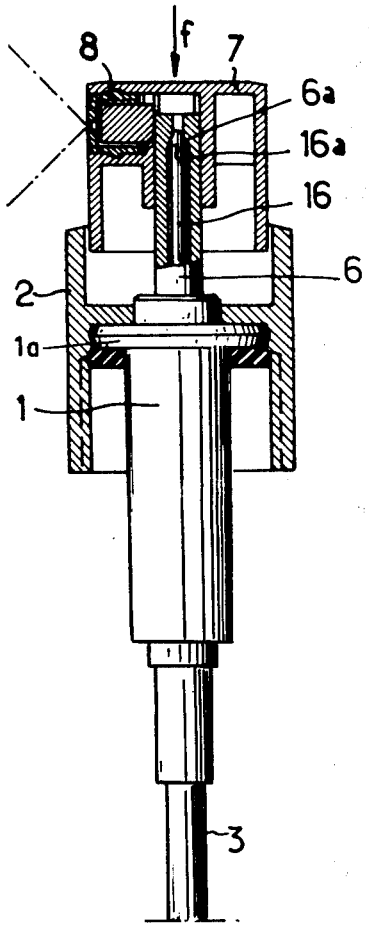
FIG. 1 is an elevation, partially in section, of an atomizer in accordance with the invention.
Figure 2:
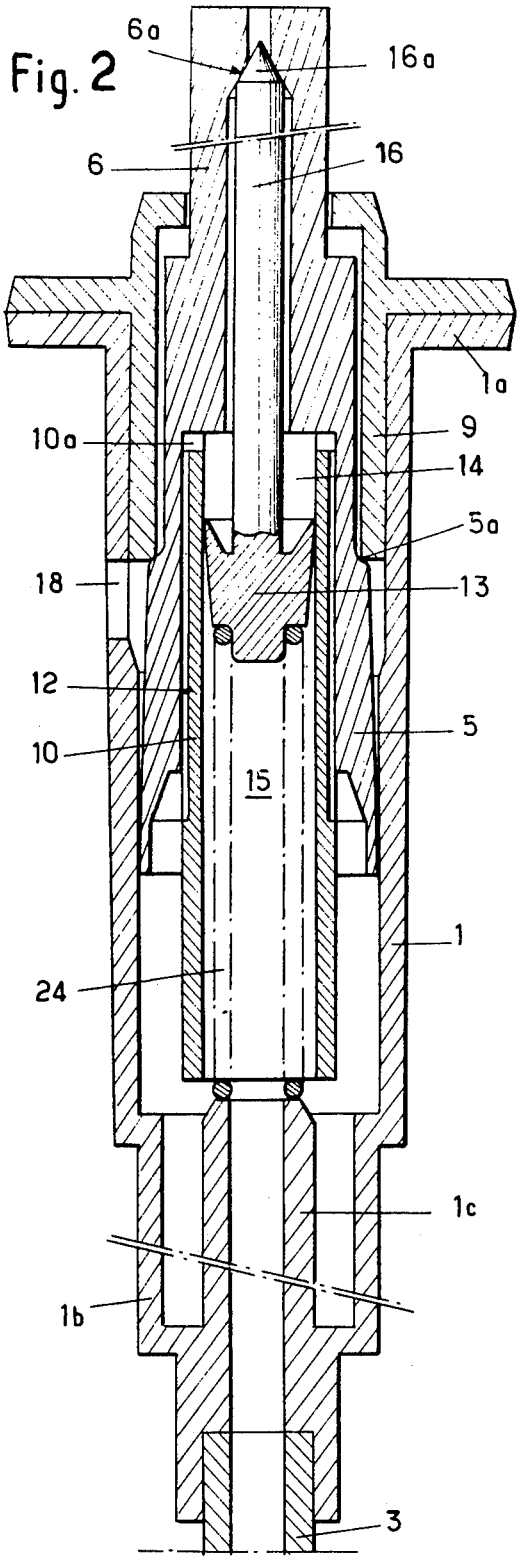
FIG. 2 is an axial section, to an enlarged scale, of part of the atomizer of FIG. 1, the atomiser being shown in an inoperative condition.
Figure 3:
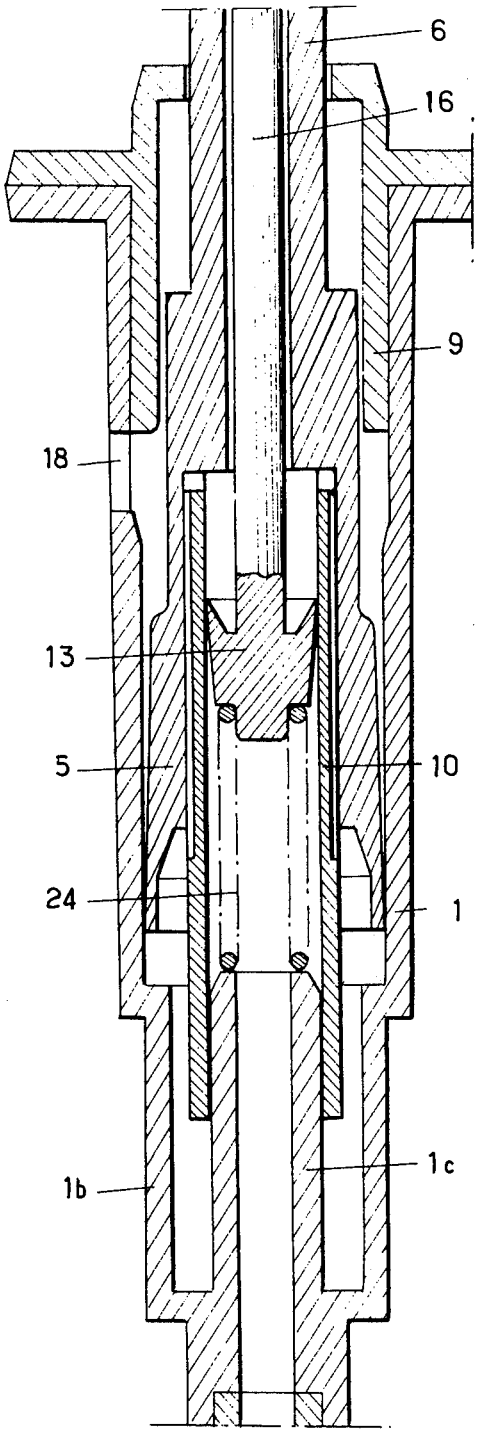
FIG. 3 is a section similar to FIG. 2 but showing the atomizer during operation.

The atomizer shown in FIGS. 1 to 3 comprises a cylinder 1 having at its upper end portion a flange 1*a* secured to a screw cap 2 intended to close a vessel containing the liquid to be atomized. The cylinder 1 is in communication at its lower end with a suction or inlet tube 3, and forms, therewith, an annular pump chamber.

Within the cylinder 1 there is slidingly mounted a hollow piston 5 carried by the lower end of a tube 6. The upper end of the tube 6 is secured to a push-button 7 which carries an atomising nozzle 8 in communcation with the tube 6. The pistons comprises a lower portion which is connected via a shoulder 5*a*, to an upper cylindrical portion of the piston 5. This latter portion of the piston is slidingly mounted with a clearance, in a sleeve 9 inserted into the cylinder 1; the shoulder 5*a* may abut against the lower end of the sleeve 9.

A sleeve 10 is partially engaged in the hollow piston 5. Longitudinal passages 12 formed in the inner surface of the hollow piston 5 or, as illustrated, in the outer surface of the sleeve 10, and openings 10*a* formed at the upper end of the sleeve 10, place the cylinder 1 in communication with the inside of the sleeve 10. The latter thus forms a cylinder, of smaller cross-section than the cylinder 1, in which is slidingly mounted a piston 13 dividing the inside of the sleeve 10 into two compartments 14 and 15.

The piston 13 is rigid with a rod 16 which extends into the tube 6. The upper end portion 16*a* of the rod 16 forms a valve member which can be engaged in a valve seat 6*a* formed in the tube 6 so that the valve member 16*a* closes the tube 6 and prevents communication between the compartment 14 of the sleeve 10 and the nozzle 8. A hole 18 is formed in the cylinder 1, just below the bottom edge of the sleeve 9.

The sleeve 10 is slidable over a tubular projection 1*c* which constitutes a conduit in communication with the suction tube 3 and projects upwardly in he lower part 1*b* of the cylinder 1. A spring 24 is interposed between the upper end of the projection 1*c* and the piston 13.

When the atomizer is in its inoperative condition as illustrated in FIG. 2, the spring 24 holds the valve member 16*a* in the seat 6*a* and also ensures that the shoulder 5*a* of the piston 5 is held against the lower end of the sleeve 9 in such manner that no air may penetrate via the hole 18 into the vessel containing the liquid to be atomized. The atomiser is thus perfectly sealed.

When a force is exerted on the tube 6 via the push-button 7 as shown by the arrow *f* in FIG. 1, the piston 5 moves downwardly in the cylinder 1. The sleeve 10 moves downwardly with the piston 5, and the lower end portion of the sleeve 10 slides over the projection 1*c* and thus the cylinder 1 from the suction tube 3 (FIG. 3). Liquid contained in the cylinder 1 thus cannot return to the suction tube 3 and the liquid is forced by the piston 5 to flow via the passages 12 and the openings 10*a* into the compartment 14 of the sleeve 10. When the liquid pressure in the compartment 14 exerts a greater force on the piston 13 than that exerted by the spring 24 on the piston 13, the piston 13 is moved downwardly within the sleeve 10 whereby the valve member 16*a* is lowered from the seat 6*a* to enable liquid to pass through the tube 6 to the nozzle 8.

When the push-button 7 is released, the spring 24 immediately moves the piston 13 upwardly so that the valve member 16*a* engages the seat 6*a;* then the spring 24 acts to return the piston 5 in an upwards direction until its shoulder 5*a* abuts against the sleeve 9.

Under the action of the negative pressure created in the sleeve 10 by the rise of the piston 13 and by the rise of the sleeve 10, the liquid rises via the suction tube 3 into the sleeve 10; when the lower end of the sleeve 10 clears the projection 1*c*, this liquid drops into the lower part 1*b* of the cylinder 1. On the other hand, the rise of the piston 5 in the cylinder 1 creates a negative pressure in the cylinder so that the liquid is drawn into the cylinder 1 from the sleeve 10 when communication is re-established between the cylinder 1 and the suction tube 3.

Figure 4:
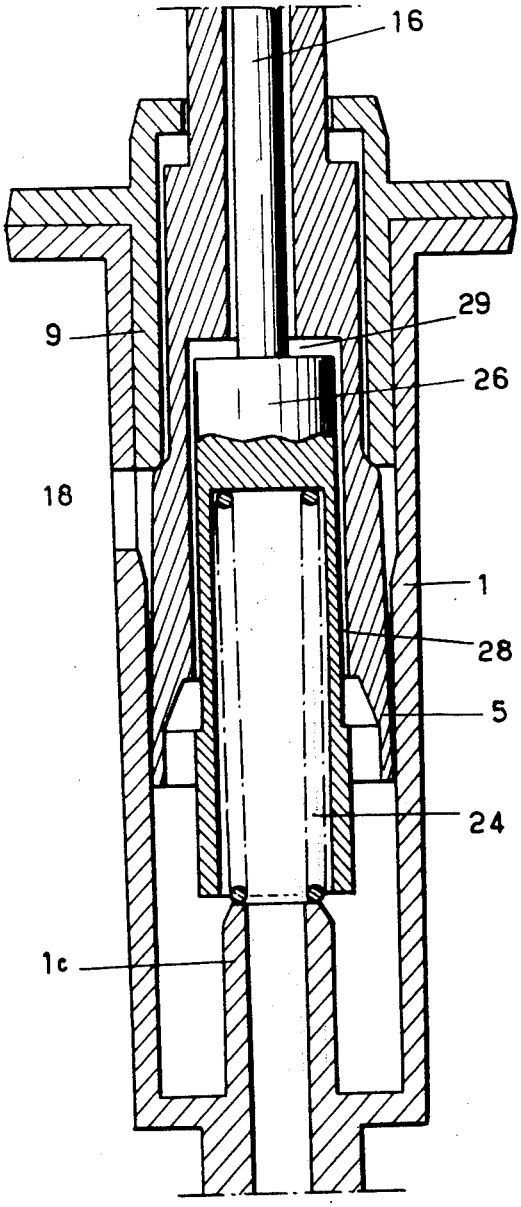
FIG. 4 is a sectional similar to FIG. 2, of another form of atomizer in accordance with the present invention.

In the embodiment of FIG. 4, the sleeve 10 and the piston 13 are replaced by a sleeve 26 which is closed at its upper end portion. The sleeve 26 thus itself forms the second piston and is slidingly installed with a clearance 28 in a cylindrical cavity 29 of the piston 5, the sleeve 26 being rigid with the rod 16 and being slidable over the projection 1*c*.

When the tube 6 is moved downwardly, the sleeve 26 engages the projection 1*c* and thus separates the cylinder 1 from the suction tube 3; subsequently when the liquid present in the cylinder 1 is under a pressure sufficient to overcome the action of the spring 24, it moves the sleeve 26 against the action of the spring 24 so that the valve member 16*a* moves off its seat 6*a*.

Figure 5:
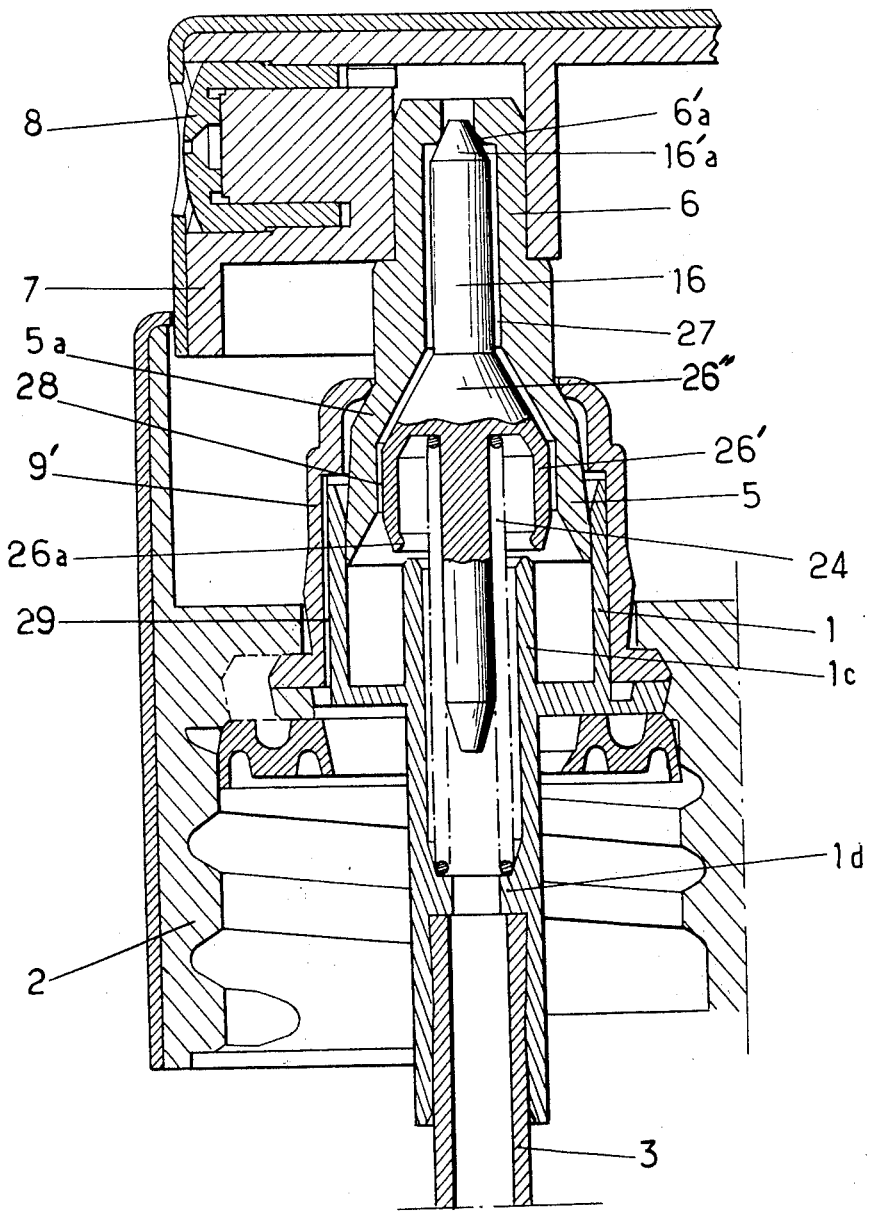
FIG. 5 is an axial section of yet another form of atomizer in accordance with the present invention.

The embodiment of FIG. 5 likewise comprises a cylinder 1 which communicates at its lower end with a suction tube 3 and which houses a hollow piston 5 rigid with a tube 6. The piston 5 is rigid with a rod 16 located in the tube 6 and having at its upper end portion a valve member 16'*a* engageable with a seat 6*a* formed in the tube 6.

The lower end of the rod 16 is rigid with a sleeve 26' to which it is connected via a solid frustoconical portion 26''. The sleeve 26' can slide over a hollow projection 1*c* which projects upwardly in the lower part of the cylinder 1 and is in communication with the suction tube. At its lower end portion, the sleeve 26' has an inner bead 26*a* which is engageable with the projection 1*c*, thus separating the inside of the suction tube from the cylinder 1. A spring 24 is interposed between the sleeve 26' and an inner shoulder 1*d* of the projection 1*c*.

The annular space 27 present between the piston 5 on the one hand and the sleeve 26' and the tube 16 on the other hand, forms a second cylinder, the frustoconical portion 26'' forming a second piston. When the valve member 16'*a* bears on its seat 6*a*, it projects downwardly with respect to the latter. Consequently, the pressure in the annular space 27 acts not only on the portion 26'' but equally on the valve member, tending to move the latter off its seat, against the action of the spring 24; the valve member thus forms a part of this second piston.

In the position illustrated in the drawing, the atomizer is in its inoperative condition and the valve member 16'*a* is held against its seat 6*a* by the spring 24, so that the cylinder 1 is separated from the nozzle 8. When the user depresses the push-button 7, the sleeve 26' slides over the projection 1*c* and separates the cylinder 1 from the suction tube 3. Since the piston 5 moves downwards into the cylinder 1 and the liquid contained in the cylinder cannot return into the suction tube, the pressure of the liquid rises.

Since the annular space 27 is in communication with the cylinder 1, the pressure in this annular space also equally increases. This pressure acts on the frustoconical portion 26'' of the sleeve 26', as well as on the part of the valve member 16'*a* which projects from the seat 6*a*, in the direction corresponding to the opening of the valve member, that is to say in the direction opposed to that in which the spring 24 acts.

When the pressure is adequate, the valve member 16'*a* moves away from the seat 6*a* and the liquid reaches the nozzle 8 under pressure.

When the user releases the push-button 7, the pressure in the cylinder 1 drops immediately and the valve member 16'*a* is again applied against its seat. The rod 16, the sleeve 26' and the piston 5 then rise again under the action of the spring 24 and a negative pressure is created in the suction tube 3 whereby liquid is drawn through the tube 3 into the sleeve 26'. When the sleeve 26' clears the projection 1*c* the liquid contained in the sleeve 26' is drawn into the cylinder 1, as a result of the negative pressure created in the cylinder by the upwards displacement of the piston 5 and flows into the cylinder around the projection 1*c*.

An outer sleeve 9' is engaged on the cylinder 1 and has a longitudinal groove 29 opening within the cap 2 whereby to permit venting of the vessel on to which this cap is screwed. At its upper part, the sleeve 9' has an opening of smaller cross-section; when the atomizer is in its inoperative condition, an externally frustoconical part 5*a* of the piston 5 abuts against the rim of this upper opening of the sleeve 9' in order to seal the venting groove 29.

In a modified arrangement (not shown) the piston 5 may have a double sealing lip, instead of a single one as illustrated.

Although in the embodiments particularly described, the sleeve 10 or 26' slides over the projection 1*c*, the sleeve may alternatively slide within the projection 1*c*.

In the atomizer particularly described, connunication between the suction tube and the pump chamber is interrupted in positive manner when the atomizer is in use, even if the latter is tilted, so that the possibility of malfunctioning is minimised.

What is claimed is:

1. In an atomizer, cylinder means, conduit means extending upwardly within the cylinder means to define therewith a pump chamber, said conduit means being capable of selective communication with the pump chamber, inlet means communicating with the conduit means, an atomizer nozzle;

passage means providing communication between the pump chamber and the nozzle, a first piston member slidable in the cylinder to force liquid from the pump chamber to the nozzle via the passage means, valve means operative to close the passage means in an inoperative condition of the atomizer, said valve means comprising means defining a valve seat movable with the first piston member, and a valve member engageable with the seat, the pressure of the liquid in the pump chamber tending to move the valve member out of engagement with the seat whereby to open the passage, bias means biasing the valve member into engage with the seat, and means movable during operation of the piston member to engage the conduit means and interrupt communication between the conduit means and the pump chamber, said movable means being rigid with one of said members.

2. An atomizer according to claim 1, wherein the said movable means is rigid with the valve member.

3. An atomizer according to claim 1, wherein the said movable means is rigid with the piston member.

4. An atomizer according to claim 1, wherein the first piston member has an internal cavity, and the said movable means comprises a sleeve located within the cavity of the first piston member and defining a second chamber in communication with the pump chamber, said atomiser further comprising a second piston member rigid with the valve member and slidable in the second chamber.

5. An atomizer according to claim 4, wherein a clearance is defined between the sleeve and the first piston member to place the second chamber in communication with the pump chamber.

6. An atomizer according to claim 4, wherein the bias means comprises a spring interposed between the second piston member and the conduit means.

7. An atomizer according to claim 4, wherein the passage means comprises tube means rigid with the first piston member, said tube means carrying said nozzle and said valve seat, said atomizer further comprising rod means connecting the valve member to the second piston member, said rod means extending into the tube means.

8. An atomizer according to claim 1, wherein the said movable means is rigid with the valve member, the first piston member has an internal cavity defining a second chamber, the movable means is slidable in the second chamber and defines a second piston member, and the second chamber communicates with the pump chamber.

9. An atomizer according to claim 8, wherein a clearance is defined between movable means and the first piston member to place thesecond chamber in communication with the pump chamber.

10. An atomizer according to claim 8 wherein the bias means comprises a spring interposed between the second piston member and the conduit means.

11. An atomizer according to claim 8, wherein the passage means comprises tube means rigid with the first piston member, said tube means carrying said nozzle and said valve seat, said atomizer further comprising rod means connecting the valve member to the second piston member, said rod means extending into the tube means.

12. An atomizer according to claim 1, wherein the valve member has a portion projecting outwardly from the seat when the valve member is in its closed position, whereby the liquid pressure acts on said projecting portion in a sense to move the valve member out of engagement with the seat.

* * * * *

UNITED STATES PATENT OFFICE

CERTIFICATE OF CORRECTION

Patent No. 4,025,046 Dated May 24, 1977

Inventor(s) Michel Boris

It is certified that error appears in the above-identified patent and that said Letters Patent are hereby corrected as shown below:

Col. 1, Line 19: "sepatate" should read --separate--

Col. 4, Line 53: "atomizer" should read --atomizers--

Col. 4, Line 53: "connunication" should read --communication--

Col. 5, Line 13 (Claim 1): "engage" should read --engagement--

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*